US012807376B2

(12) United States Patent
Albisetti et al.

(10) Patent No.: US 12,807,376 B2
(45) Date of Patent: Nov. 24, 2026

(54) SMALL WALL THICKNESS INJECTED CONTAINER AND SCREW CLOSURE

(71) Applicant: L'OREAL, Paris (FR)

(72) Inventors: Nicolas Albisetti, Clichy (FR); Luc Maelstaf, Clichy (FR)

(73) Assignee: L'Oreal, Paris (FR)

( * ) Notice: Subject to any disclaimer, the term of this patent is extended or adjusted under 35 U.S.C. 154(b) by 46 days.

(21) Appl. No.: 18/273,098

(22) PCT Filed: Jan. 17, 2022

(86) PCT No.: PCT/EP2022/050844
§ 371 (c)(1),
(2) Date: Jul. 19, 2023

(87) PCT Pub. No.: WO2022/157103
PCT Pub. Date: Jul. 28, 2022

(65) Prior Publication Data

US 2024/0083638 A1 Mar. 14, 2024

(30) Foreign Application Priority Data

Jan. 20, 2021 (EP) ..... 21305067

(51) Int. Cl.
*B65D 43/02* (2006.01)

(52) U.S. Cl.
CPC ..... *B65D 43/0231* (2013.01); *B65D 2543/00296* (2013.01); *B65D 2543/00509* (2013.01); *B65D 2543/00537* (2013.01); *B65D 2543/00555* (2013.01); *B65D 2543/00583* (2013.01)

(58) Field of Classification Search
CPC ..... B65D 43/0231; B65D 2543/00296; B65D 2543/00509; B65D 2543/00583
USPC ..... 220/796, 782
See application file for complete search history.

(56) References Cited

U.S. PATENT DOCUMENTS 3,817,420 A 6/1974 Heisler
3,861,433 A * 1/1975 Schier ..... B65D 43/0222 D7/610
4,348,421 A * 9/1982 Sakakibara ..... A47J 47/14 426/112

(Continued)

FOREIGN PATENT DOCUMENTS

CH 679770 A5 4/1992
EP 1122184 A1 8/2001

(Continued)

OTHER PUBLICATIONS

International Preliminary Report on Patentability in PCT/EP2022/050844, mailed Jul. 20, 2023, 7 pages.

(Continued)

*Primary Examiner* — Jeffrey R Allen
(74) *Attorney, Agent, or Firm* — The Marbury Law Group, PLLC

(57) ABSTRACT

A container (1) comprising: •—a jar (10) made of at least one injected thermoplastic material and comprising a body (11) having an inner wall (15) defining an opening and an outer skirt (16) concentric with the inner wall and connected thereto, the outer skirt (16) having a radially outer surface with at least one helical thread (31), •—a closure lid (20) having at least one helical thread (33) for screwing on the outer skirt of the jar.

16 Claims, 1 Drawing Sheet

(56) References Cited

U.S. PATENT DOCUMENTS

Figure 1:
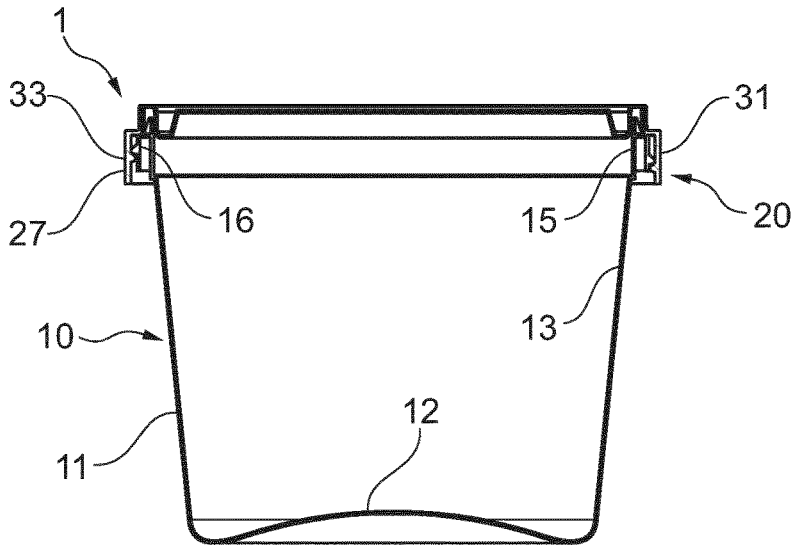

| | | | | |
|---|---|---|---|---|
| 5,542,532 | A | 8/1996 | Mitchell | |
| 6,170,691 | B1 * | 1/2001 | Morris, Sr. | B65D 43/0231 206/508 |
| 7,523,839 | B2 | 4/2009 | Savicki | |
| 8,608,009 | B2 * | 12/2013 | Ogawa | B65D 43/0231 220/302 |
| 11,014,716 | B2 * | 5/2021 | Tyler | B65D 51/1688 |
| 2002/0175173 | A1 | 11/2002 | Diesterbeck | |
| 2006/0201947 | A1 * | 9/2006 | Pickles | B65D 1/22 220/326 |

FOREIGN PATENT DOCUMENTS

| | | | |
|---|---|---|---|
| EP | 1268289 | B1 | 1/2005 |
| EP | 2392521 | A1 | 12/2011 |
| WO | 2011129866 | A1 | 10/2011 |

OTHER PUBLICATIONS

International Search Report and Written Opinion in PCT/EP2022/050844, mailed Apr. 4, 2022, 10 pages.

* cited by examiner

SMALL WALL THICKNESS INJECTED CONTAINER AND SCREW CLOSURE

CROSS REFERENCE TO RELATED APPLICATIONS

This is a National Stage Application of PCT/EP2022/050844, filed internationally on Jan. 17, 2022, which claims priority to European Application No. 21305067.7, filed on Jan. 20, 2021, both of which are incorporated by reference herein in their entireties.

The present invention relates to a thermoplastic container.

PRIOR ART

Some cosmetics are packaged in containers consisting of a jar provided with a screw closure lid.

The jar may be made of thermoplastic materials. There is a need to diminish the weight of material for environmental purposes.

It is known in the food industry to make light weight containers by thermoforming a sheet of plastic material. However, most of these containers have a closure lid that is fastened to the corresponding jar by snap fastening, not screwing. These containers are not satisfactory for holding cosmetics as the consumers are used to open and close the container by unscrewing or screwing the closure lid.

EP 1268289, EP 2392521, EP 1122184, U.S. Pat. No. 5,542,532 or 3,817,420 relate to containers with a snap-in lid.

U.S. Pat. No. 7,523,839 discloses a ventable spin lock food container made by thermoforming a thermoplastic material. The container includes a bowl provided with a flange extending downwardly to define an outer skirt on which threads are formed. These threads cooperate with corresponding ones formed on the lid to create a vent for avoiding building of internal pressure during microwave heating. The material of the container is sufficiently resiliently deformable to facilitate cooperation between the lid and bowl threads. Such a container may be appropriate for packaging a food product but may not meet the standards of the cosmetic industry relating to handing resistance, tightness and sensoriality.

U.S. Pat. No. 8,608,009 discloses a container made by thermoforming a sheet of plastics material. The jar is made with some projections allowing to lock the closure after some rotation. The closure lid is made with small bosses that can engage under the projections during the locking. Such a container suffers the drawbacks due to the use of a thermoformed material.

SUMMARY OF THE INVENTION

There thus remains a need for an improved container suitable for holding cosmetics and that can be manufactured with a thin wall thickness and a reduced weight of plastics material.

Exemplary embodiments of the present invention aim at satisfying this need and relate to a container comprising:

- a jar made of at least one injected thermoplastic material and comprising a body having an inner wall defining an opening and an outer skirt concentric with the inner wall and connected thereto, the outer skirt having a radially outer surface with at least one helical thread,
- a closure lid having at least one helical thread for screwing on the outer skirt of the jar.

Thanks to the double skirt the invention enables to make the jar with a body of reduced wall thickness while providing enough rigidity and mechanical strength to withstand the screwing of the closure lid and achieve the desired sealing. The container may also withstand internal overpressure to some extent. The use of injected plastics materials allows to mold the jar with a relatively high precision, thus avoiding the need for designing the cooperating threads with a high resiliency to compensate for poor manufacture tolerances, contrary to thermoformed containers with screw lids. Accordingly, quality and sensoriality standards of the cosmetic industry are easier to meet. As the jar is made by an injection process, it comprises at least one trace of injection point, for example in the middle of its bottom.

Preferably, both the jar and the lid each have a plurality of helical threads, which allows a quick fastening of the closure lid by screwing.

The jar is preferably made monolithically in one piece of a same injected material in a single molding operation, and the lid also.

Preferably, the container comprises a plurality of reinforcing ribs in the groove formed by the inner wall and outer skirt. These ribs preferably connect the inner wall to the outer skirt. This improves the rigidity of the double skirt and help reduce the wall thickness of the jar. The ribs may extend axially on a distance that is less than a height of the outer skirt. Accordingly, the lower end of the ribs may be remote from the lower edge of the outer skirt.

This reduces the visibility of the ribs and may help stacking empty jars on top of each other when the closure lid is absent. The number of ribs ranges from 6 to 30 for example. The radial dimension of the ribs ranges from 1 to 3 mm for example. All the ribs may be identical, or some may have a greater length than others.

Preferably, the container comprises a transverse wall connecting the inner wall to the outer skirt. In such case, the ribs preferably extend under said annular transverse wall, inside the groove defined between the inner wall and the outer skirt. The height of the ribs is preferably shorter than the depth of the groove, as mentioned above. In this way, the ribs are hidden by the outer skirt from view to a larger extent, which is advantageous for aesthetical reasons. The transverse wall connecting the inner wall to the outer skirt may be a continuous annular flange or a discontinuous flange, comprising openings. This may enable a further reduction of the quantity of material used for manufacturing the jar.

The inner wall may extend above the transverse annular wall to define a sealing lip for the closure lid. The presence of such lip is advantageous to obtain a good sealing of the closure when the closure lid is screwed on the jar. The height of the sealing lip ranges from 2 to 4 mm, for example. The sealing lip together with the inner wall, transverse wall and outer skirt may have an h profile in section, the lip preferably having a same internal diameter as the portion of the inner wall extending below the transverse wall. In the absence of the lip, the lid may press against the inner wall to obtain a tight closure.

The container capacity ranges for example from 100 mL to 500 mL. The body of the jar may have any shape. In exemplary embodiments, the body has a conical wall to which the inner wall connects via a shoulder. This allows stacking of the jars. The bottom of the container may be convex toward the interior of the jar.

The invention is particularly advantageous for large jars with an opening of a large diameter, typically of a least 5 cm, for example ranging from 5 to 15 cm, better from 7 to 12 cm.

The inner wall of the jar may have a thickness less than 1 mm, preferably less than 0.7 mm, for example of about 0.6 mm. The outer skirt may have the same thickness as the inner wall, except where it carries the helical threads. The transverse wall connecting the inner wall to the outer skirt may have the same thickness as the inner wall. The sealing lip may have the same thickness as the outer skirt except where it carries threads.

The closure lid preferably has an outer skirt provided with said at least one helical thread, said outer skirt being connected via a transverse wall to a first annular portion defining a first groove opening downwards.

The sealing lip may bear on a radially inner surface of said first groove of the lid. This groove may have a substantially inverted U profile in section. The closure lid preferably comprises reinforcing ribs extending in said groove. These ribs may extend up to the transverse wall of the lid connecting the outer skirt to the first annular portion. The lower edge of these ribs may have an inclined profile. The length of the ribs where they connect to the radially inner surface of the first groove may be less than where they connect to the radially outer surface of the groove. The lower edge may extend from the radially inner surface in a direction perpendicular to the longitudinal axis of the container for about half the width of the groove and then extend downwardly and radially outwards.

The closure lid may comprise a second annular portion defining a second groove opening upwards.

The closure lid preferably has a surface that abuts against a corresponding surface of the jar once the lid is screwed onto the jar to prevent further screwing of the lid and thus avoids submitting the helical threads and corresponding skirts to an excessive stress. Preferably, the transverse wall to which the outer skirt of the lid connects to the reaming of the lid comes into axial abutment with the transverse wall connecting the inner wall of the jar to the outer skirt of the jar, to prevent further rotation of the lid. The closure lid may come into abutment with jar in an annular zone that is situated above the outer skirt of the jar. The surfaces that bear against each other during such abutment may be flat and oriented perpendicularly to the longitudinal axis of the container.

The closure lid is preferably made of an injected thermoplastic material.

The invention also relates to a method for manufacturing a container as defined above, in which the jar is made by injection molding.

Figure 2:
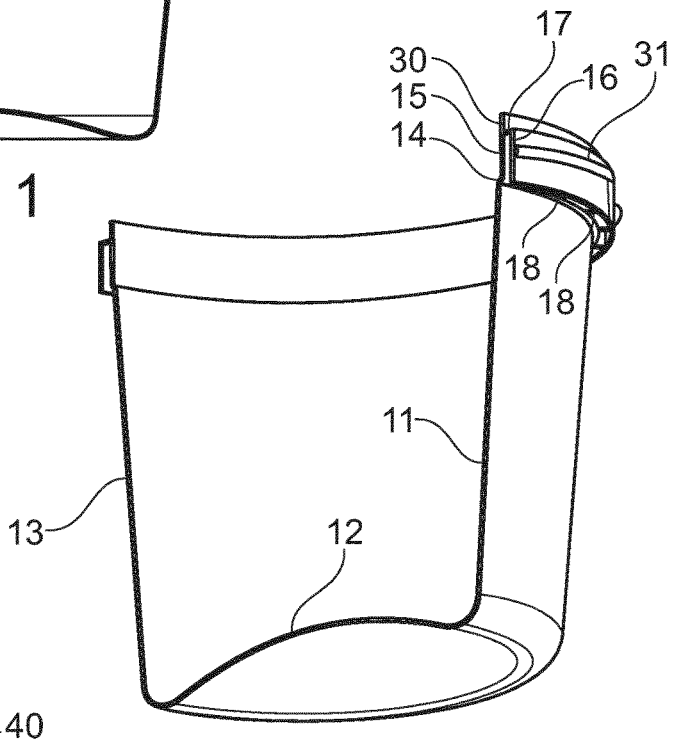
Figure 3:
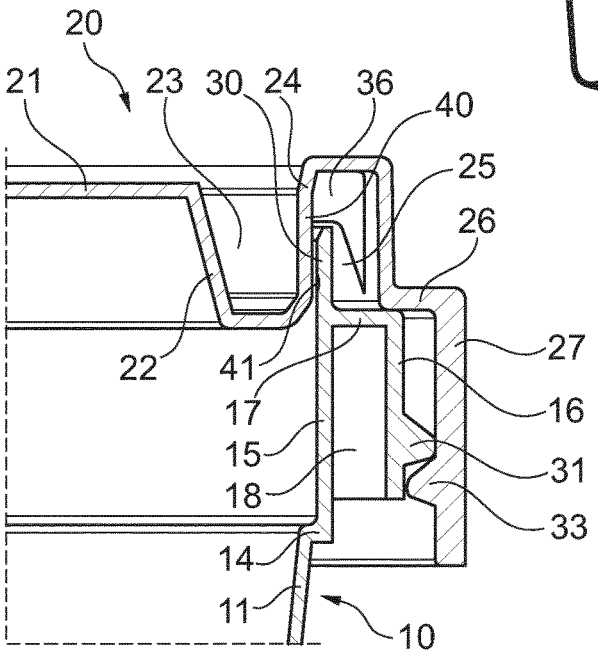

In the appended drawings:

FIG. 1 is a partial and schematic longitudinal section of a container made in accordance with the invention, FIG. 2 is a partial and schematic longitudinal section showing the jar in isolation, and FIG. 3 shows a detail of FIG. 1.

The container 1 shown in the Figures comprises a jar 10 and a corresponding screw closure lid 20.

The body 11 of the jar 10 has a slightly conical wall 13 enlarging upwards and connecting at a lower end to a bottom 12. The wall 13 connects via a shoulder 14 oriented radially outwards to an inner wall 15 that is substantially cylindrical about the longitudinal axis of the container 1.

An outer skirt 16 extends coaxially with the inner skirt 15 around the latter and connects thereto via an annular transverse wall 17, that is oriented substantially perpendicularly to the longitudinal axis of the container 1.

Reinforcing ribs 18 connect the inner skirt 15 to the outer skirt 16. Each rib 18 is oriented radially and extend within the height of the annular groove 19 defined by the inner wall 15 and outer skirt 16.

As shown, the ribs 18 may extend along the entire height of said groove 19, but in variant embodiments, the height of the ribs may be shorter.

Preferably, the ribs 18 connect at their upper end to the transverse wall 17, but in variant embodiments, the ribs 18 may be spaced from said wall 17.

The transverse wall 17 connects to the inner wall 15 at a distance from the top end of said inner wall 15.

The inner skirt 15 thus defines above the transverse wall 17 a sealing lip 30 that is configured for contacting the closure lid 20, as will be further detailed below.

The lip 30 gives the upper portion of the jar 10 a h profile in section, as can best be seen in FIG. 3.

The outer skirt 16 is provided on is radially outer surface with a plurality of helical threads 31.

These helical threads 31 are angularly spaced from each other.

The closure lid 20 comprises a central portion 21 that is substantially flat in the example shown and that may be in variant embodiments of different shapes.

The central portion 21 connects at its periphery to an annular portion 22 defining an annular groove 23 opening upwards.

The portion 22 is surrounded by another annular portion 24 of a substantially inverted U profile in section, defining an annular groove 25 opening downwards.

This annular portion 24 connects via a transverse wall 26 to an outer skirt 27 that is provided with a plurality of helical threads 33 on its internal surface.

The threads 31 and 33 are configured to enable fast screwing of the lid 20 onto the jar 10, by less than a quarter of a turn.

In the described example, there are five helical threads 31 and as many helical threads 33, the closing being performed by rotating the lid about ⅕ of a turn.

The lid 20 comprises reinforcing ribs 36 extending within the groove 25.

When the lid 20 is screwed on the jar 10, the lower surface of the transverse wall 26 of the lid comes into abutment with the upper surface of the transverse wall 17 of the jar 10, as shown in FIG. 3. The lip 30 then extends within the groove 25 in contact with the lid 20 and seals the container. The ribs 36 are configured so that they do not prevent the insertion of the lip 30 into the groove 25. The length of the ribs 36 is shorter where they connect to the radially inner surface of the groove 25 than where they connect to the radially outer surface of the groove.

The annular portion 22 may have any appropriate profile for obtaining the desired seal. The wall 40 of the lid separating the grooves 23 and 25 may exhibit as shown in FIG. 3 an annular bead 41 protruding radially outwardly, that presses on the lip 30.

The jar 10 and lid 20 are both made by injection of a plastics material such as a polyolefin (for example PP) or PET. The container may be made in a transparent or opaque plastics material. The injection of the jar made take place at the middle of the bottom 12.

The injection is carried out with suitable equipment allowing to make walls of small thickness, typically less or equal to 1 mm. The thickness of the inner wall 15 may be 0.6 mm. The transverse wall 17 and outer skirt 16 may have a same thickness of 0.6 mm, except for the threads 31, which may be thicker.

The thickness of the conical wall 13 may also be of 0.6 mm.

The outer skirt 27 of the lid 20 may have a thickness that is larger than that of the central portion 21, as shown. The transverse wall 26 may also be thicker than the central portion 21, but thinner than the outer skirt 27. For example, the thickness of the outer skirt 27 may be about twice than that of the central portion 21.

The jar 10 may be used as a bowl for holding a cosmetic composition such as a hair product or any other product.

In a variant, the jar 10 constitutes a refill that is introduced into a base of desired appearance.

The invention is not restricted to the disclosed embodiments and various changes may be brought to the jar or lid. For example, the jar is made without the sealing lip 30 and the tightness of the closure may be obtained in a different manner.

The jar 10 may be made without the ribs 18, in which case the thickness of the outer skirt 16 may be increased.

The lid 20 may have a different shape and be provided for example with a sealing lip configured for contacting a corresponding surface of the jar.

The invention claimed is:

1. A container comprising:

a jar comprising a body having an inner wall configured to be an opening and an outer skirt concentric with the inner wall and connected to the inner wall, the outer skirt comprising a radially outer surface with at least one helical thread, the inner wall having a thickness less than 1 mm, wherein the jar comprises at least one injected thermoplastic material, the inner wall forming a sealing lip; and a closure lid comprising at least one helical thread for screwing on the outer skirt of the jar, the lid comprising an annular groove opening downwards and first reinforcing ribs extending within the annular groove, wherein when the lid is screwed on the jar, the lip bears on a radially inner surface of the annular groove and the lip engages with an annular bead on the radially inner surface of the annular groove, without any additional seal interposed between the jar and the lid.

2. The container according to claim 1, further comprising a plurality of second reinforcing ribs disposed between the inner wall and the outer skirt.

3. The container according to claim 2, wherein the number of the plurality of second reinforcing ribs ranges from 6 to 30.

4. The container according to claim 1, further comprising a transverse annular wall configured to connect the inner wall to the outer skirt.

5. The container according to claim 2, wherein the plurality of second reinforcing ribs extend under the annular transverse wall.

6. The container according to claim 4, wherein the sealing lip formed on the inner wall extends above the transverse wall.

7. The container according to claim 1, wherein the body comprises a conical wall connected to the inner wall via a shoulder.

8. The container according to claim 1, wherein the opening has a diameter of a least 5 cm.

9. The container according to claim 1, wherein the closure lid comprises an outer skirt comprising at least one helical thread, wherein the outer skirt is connected to a first annular portion via a transverse wall forming the annular groove opening downward.

10. The container according to claim 9, wherein the inner wall extends above the transverse wall and is configured to be the sealing lip, and wherein the sealing lip is attached to a radially inner surface of the annular groove when the container is closed.

11. The container according to claim 1, wherein the annular groove has a substantially inverted U profile in section.

12. The container according to claim 1, wherein the closure lid comprises a second annular portion configured to be a second groove opening upward.

13. The container according to claim 1, wherein the closure lid comprises an injected thermoplastic material.

14. The container according to claim 1, wherein the closure lid comprises a first transverse wall connected to the outer skirt in an axial abutment with a second transverse wall that connects the inner wall to the outer skirt of the jar to prevent further rotation of the lid when the latter is screwed on the jar.

15. The container according to claim 1, wherein the inner wall has a thickness less than 0.7 mm.

16. The container according to claim 2, wherein the plurality of second reinforcing ribs extend axially to a distance of less than the height of the outer skirt.

* * * * *